US010612268B1

(12) United States Patent
Bobucky et al.

(10) Patent No.: US 10,612,268 B1
(45) Date of Patent: Apr. 7, 2020

(54) PORTABLE CANOPY ASSEMBLY

(71) Applicants: Andrew Bobucky, Cranford, NJ (US); Angelo Margino, Cranford, NJ (US)

(72) Inventors: Andrew Bobucky, Cranford, NJ (US); Angelo Margino, Cranford, NJ (US)

( * ) Notice: Subject to any disclaimer, the term of this patent is extended or adjusted under 35 U.S.C. 154(b) by 0 days.

(21) Appl. No.: 16/399,212

(22) Filed: Apr. 30, 2019

(51) Int. Cl.
*E04H 15/56* (2006.01)
*E04H 15/48* (2006.01)
*E04H 15/36* (2006.01)

(52) U.S. Cl.
CPC ..... *E04H 15/56* (2013.01); *E04H 15/36* (2013.01); *E04H 15/48* (2013.01)

(58) Field of Classification Search
CPC ..... E04H 15/56
See application file for complete search history.

(56) References Cited

U.S. PATENT DOCUMENTS 1,746,507 A * 2/1930 Wolff ..... B65D 5/302 229/192
2,036,033 A * 3/1936 Fisher ..... E04H 15/003 135/133
2,266,853 A * 12/1941 Dabney ..... E04H 15/003 135/126
2,502,103 A * 3/1950 Puls ..... A47C 29/003 135/155
2,851,045 A 9/1958 Haselton
3,006,705 A * 10/1961 Williams ..... A47B 83/04 108/14
D288,613 S 3/1987 James
5,059,463 A 10/1991 Peters
5,299,331 A 4/1994 Badillo
5,515,564 A * 5/1996 Lyons ..... A47C 1/14 190/1
5,690,134 A 11/1997 McCauley
6,199,230 B1 3/2001 Parikh
7,607,182 B1 10/2009 Weiner
2005/0136793 A1* 6/2005 Strunk ..... A47D 13/063 446/487
2006/0169690 A1* 8/2006 Rothschild ..... A45C 7/0036 220/7
2007/0006910 A1* 1/2007 Chu ..... A47D 9/005 135/133

FOREIGN PATENT DOCUMENTS

GB 443728 A * 3/1936 ..... E04H 15/56
WO WO2006053286 5/2006

* cited by examiner

*Primary Examiner* — Noah Chandler Hawk

(57) ABSTRACT

A portable canopy assembly for providing shade for outdoor events includes a mat that is foldable along pre-determined fold lines such that the mat forms a box. A plurality of stakes is each extendable through the mat at predetermined locations when the mat is folded to define the box. In this way each of the stakes penetrates a support surface for inhibiting the box from sliding on the support surface. A frame is provided and the frame is positionable between a collapsed position and a deployed position. The frame defines a half shell when the frame is positioned in the deployed position and the frame is positionable around the box when the mat is folded to define the box. A canopy is coupled to the frame such that the canopy extends partially over the box when the frame is positioned in the deployed for shading the box.

11 Claims, 9 Drawing Sheets

PORTABLE CANOPY ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to canopy devices and more particularly pertains to a new canopy device for providing shade during outdoor events.

BRIEF SUMMARY OF THE INVENTION

An embodiment of the disclosure meets the needs presented above by generally comprising a mat that is foldable along pre-determined fold lines such that the mat forms a box. A plurality of stakes is each extendable through the mat at predetermined locations when the mat is folded to define the box. In this way each of the stakes penetrates a support surface for inhibiting the box from sliding on the support surface. A frame is provided and the frame is positionable between a collapsed position and a deployed position. The frame defines a half shell when the frame is positioned in the deployed position and the frame is positionable around the box when the mat is folded to define the box. A canopy is coupled to the frame such that the canopy extends partially over the box when the frame is positioned in the deployed for shading the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
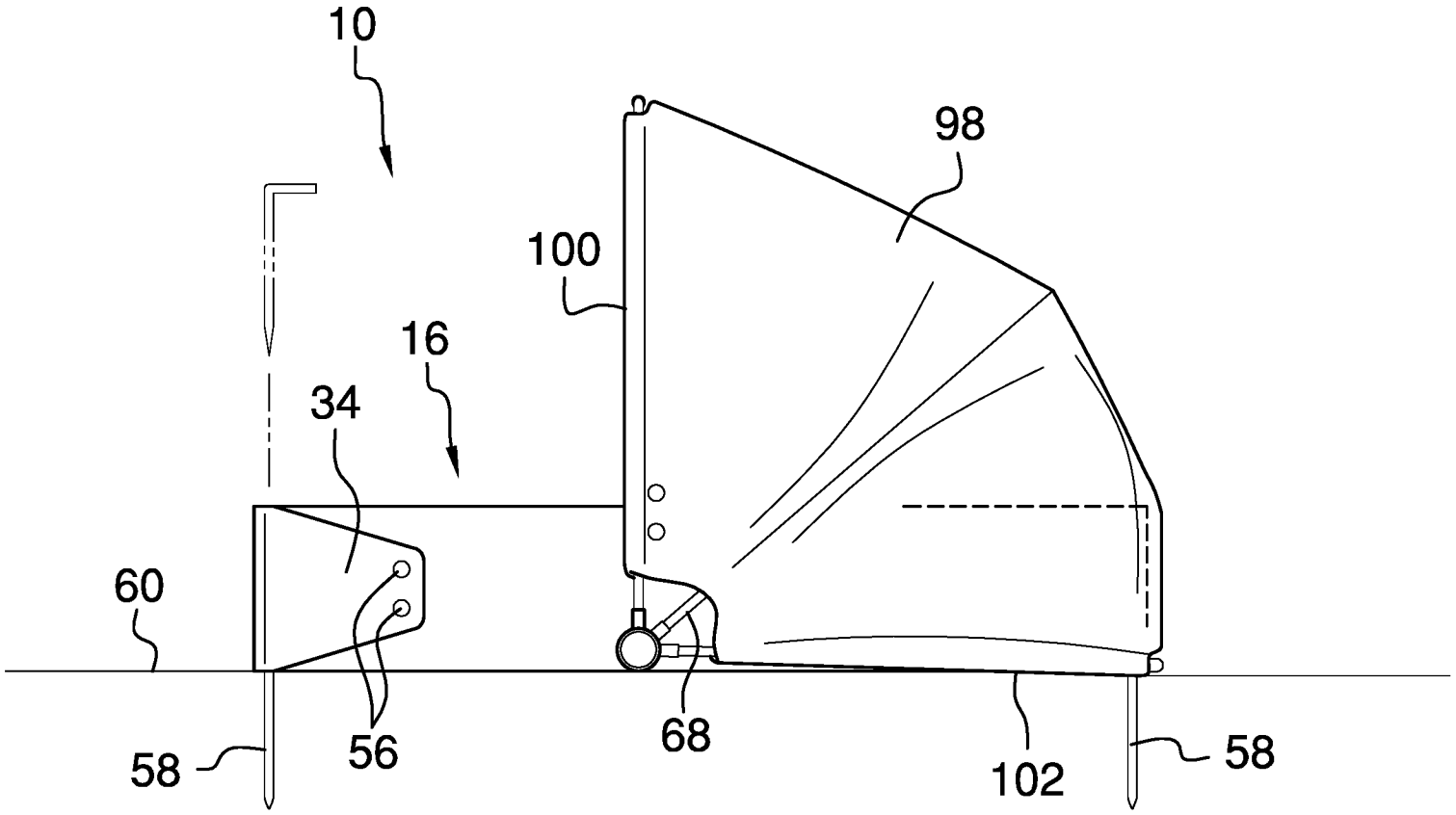
FIG. 1 is a left side view of a portable canopy assembly according to an embodiment of the disclosure.
Figure 2:
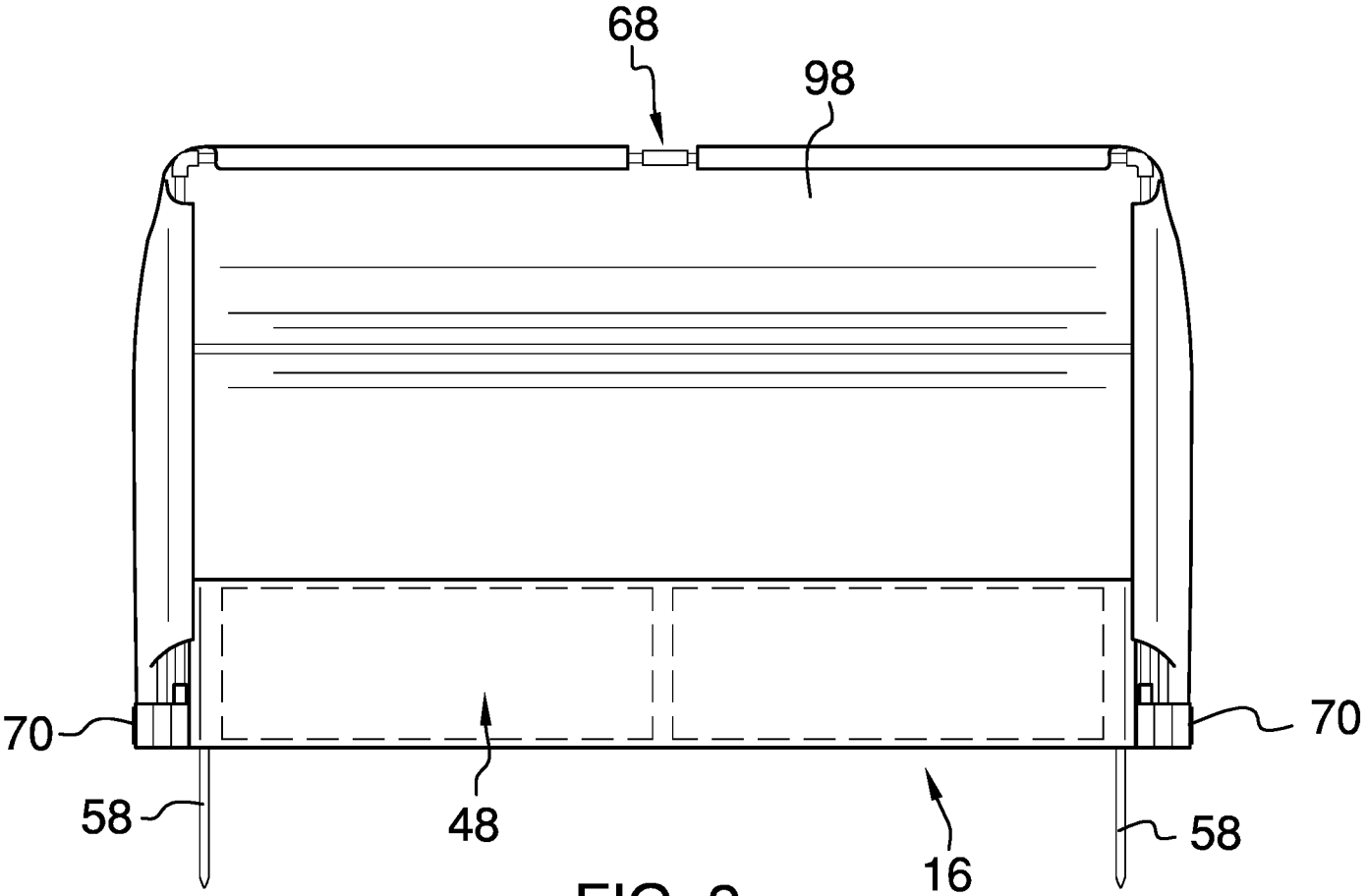
FIG. 2 is a front view of an embodiment of the disclosure.
Figure 3:
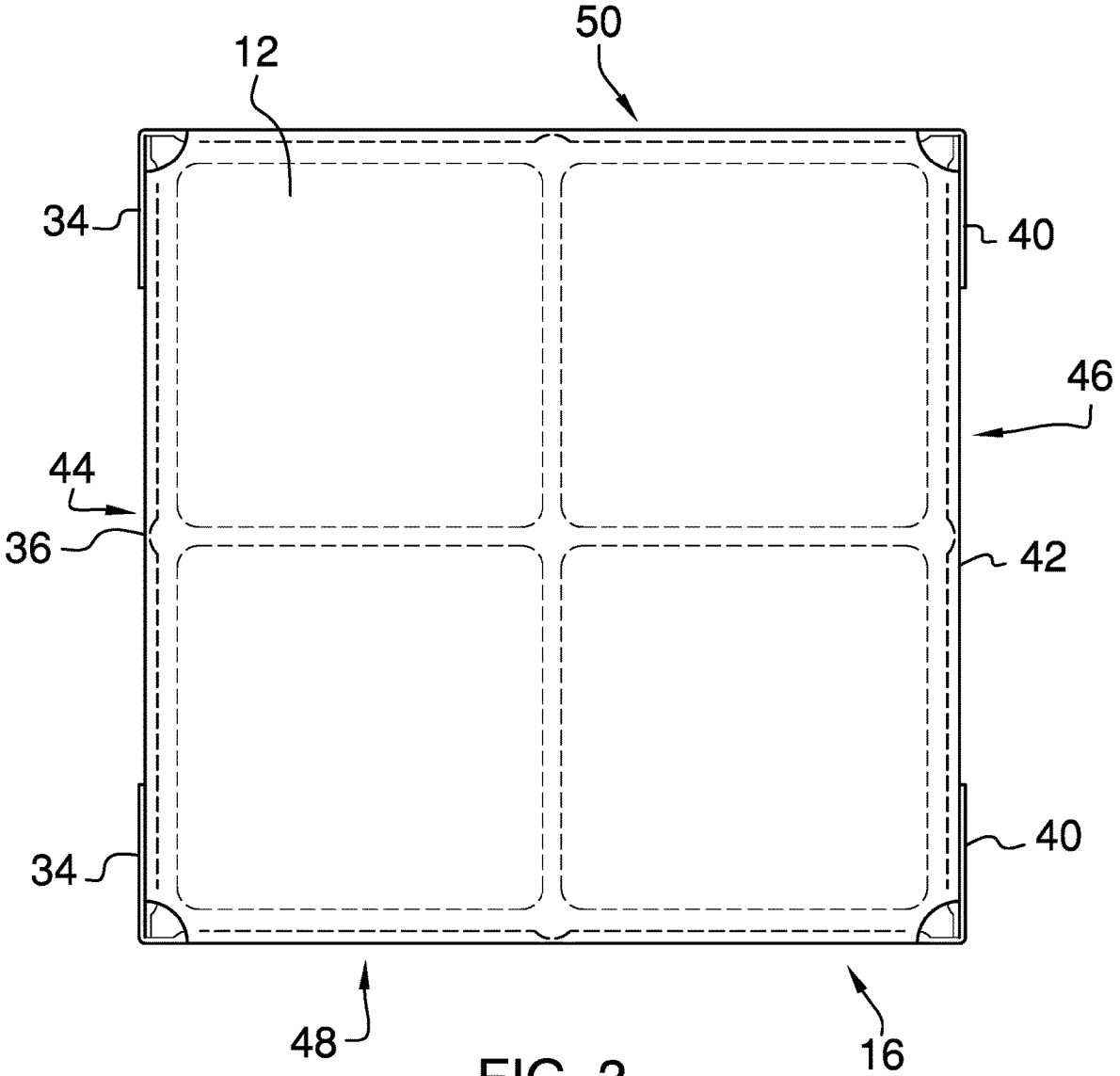
FIG. 3 is a top view of a mat of an embodiment of the disclosure having been folded to define a box.
Figure 4:
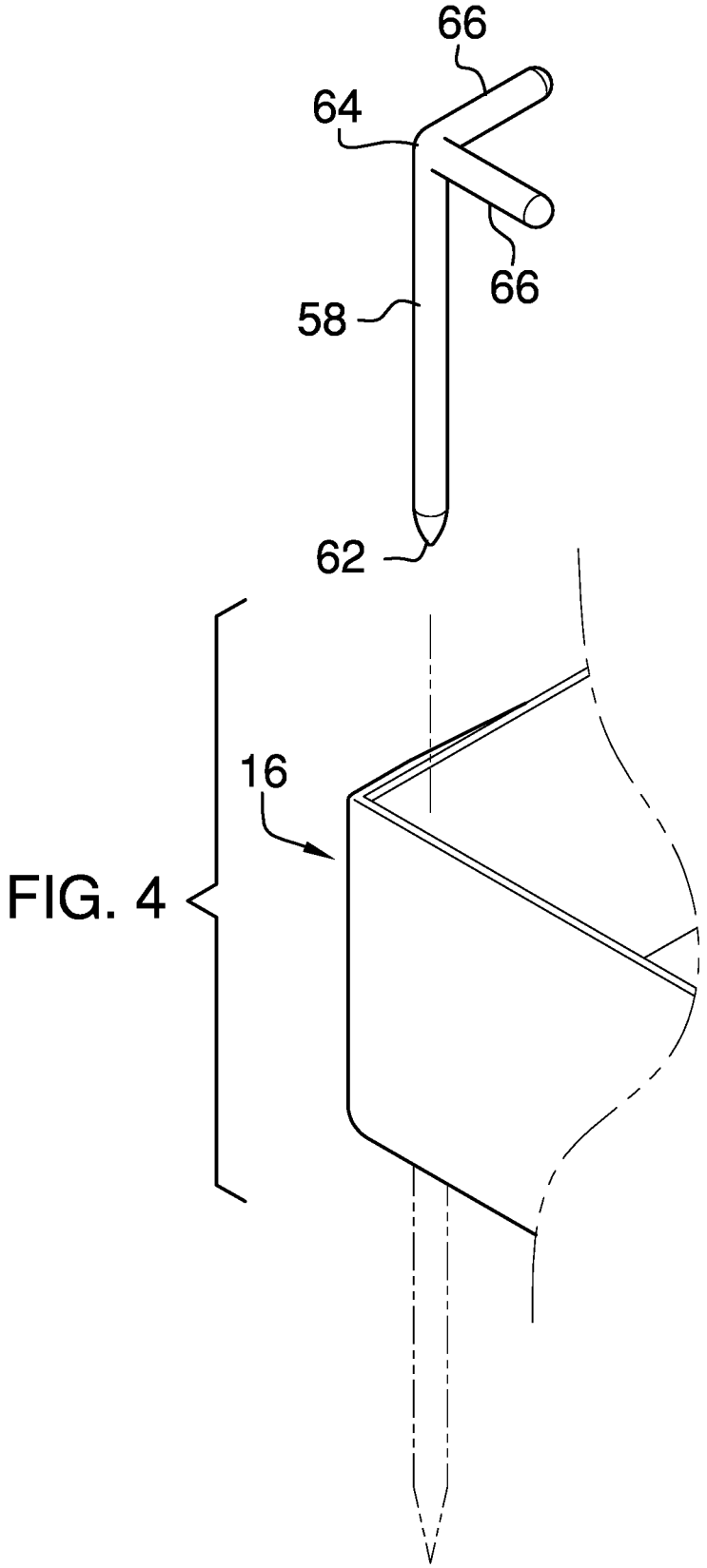
FIG. 4 is an exploded perspective view of a stake and a box of an embodiment of the disclosure.
Figure 5:
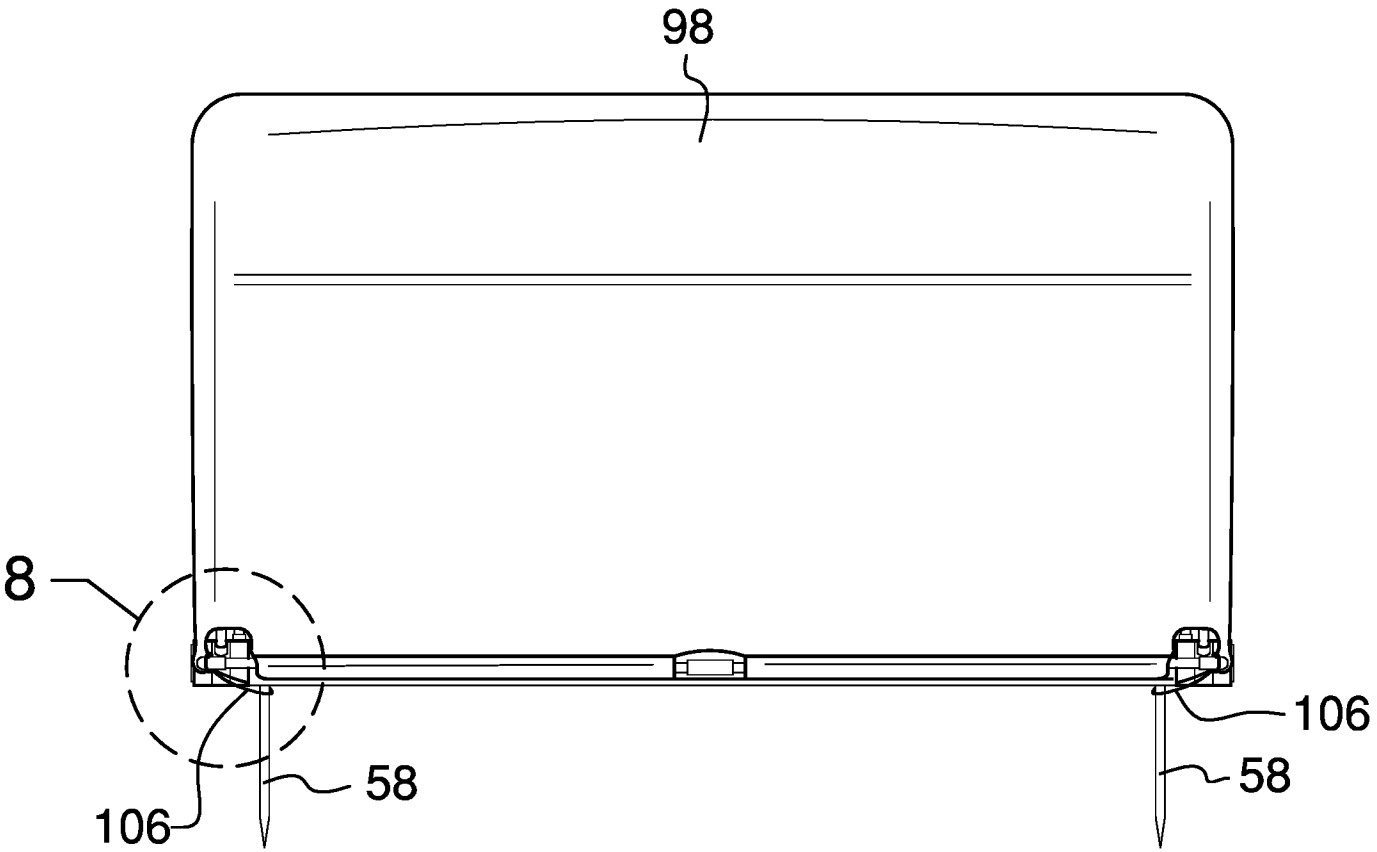
FIG. 5 is a back view of an embodiment of the disclosure.
Figure 6:
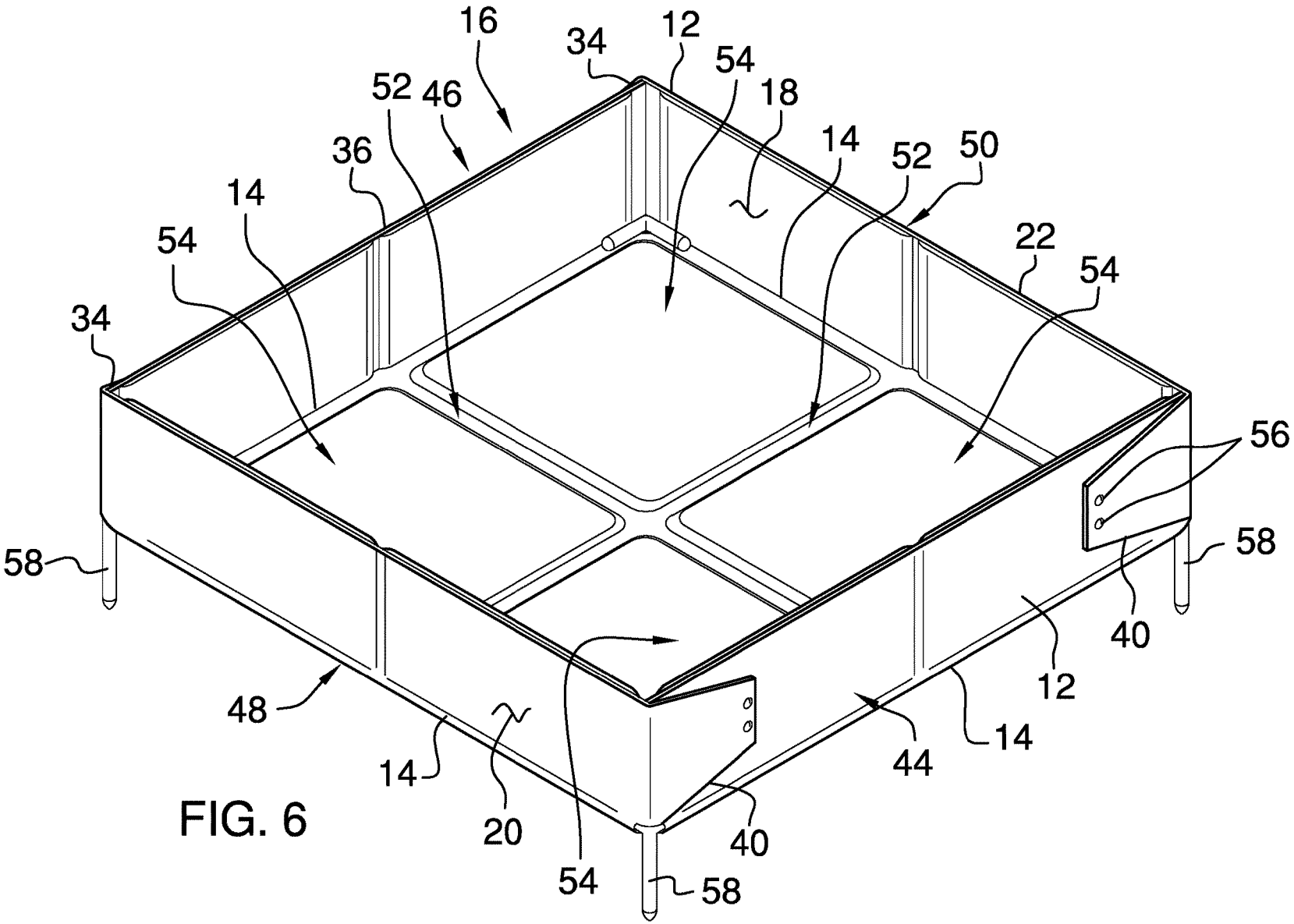
FIG. 6 is a top perspective view of a mat of an embodiment of the disclosure having been folded into a box.
Figure 7:
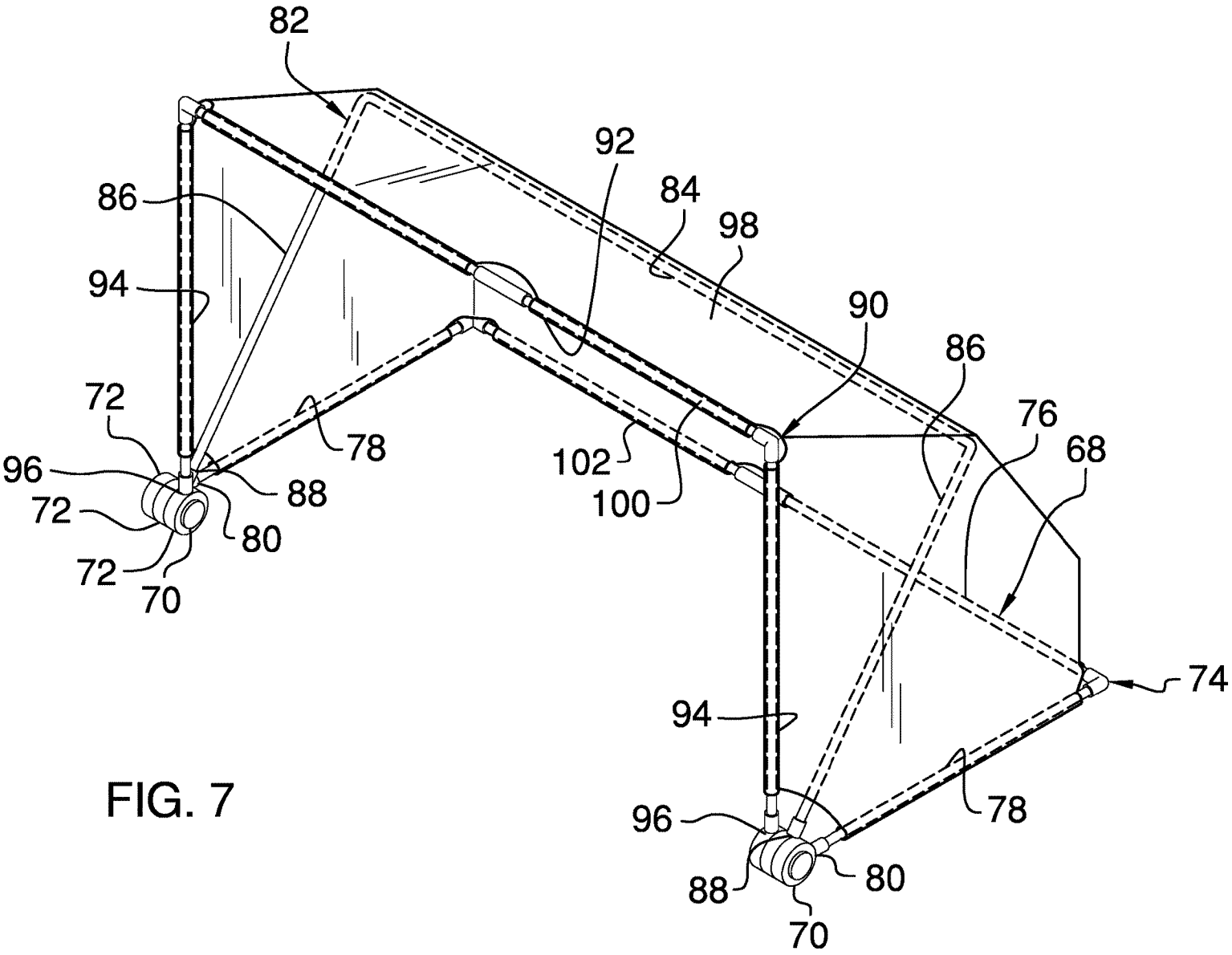
FIG. 7 is a perspective phantom view of a frame and a canopy of an embodiment of the disclosure.
Figure 8:
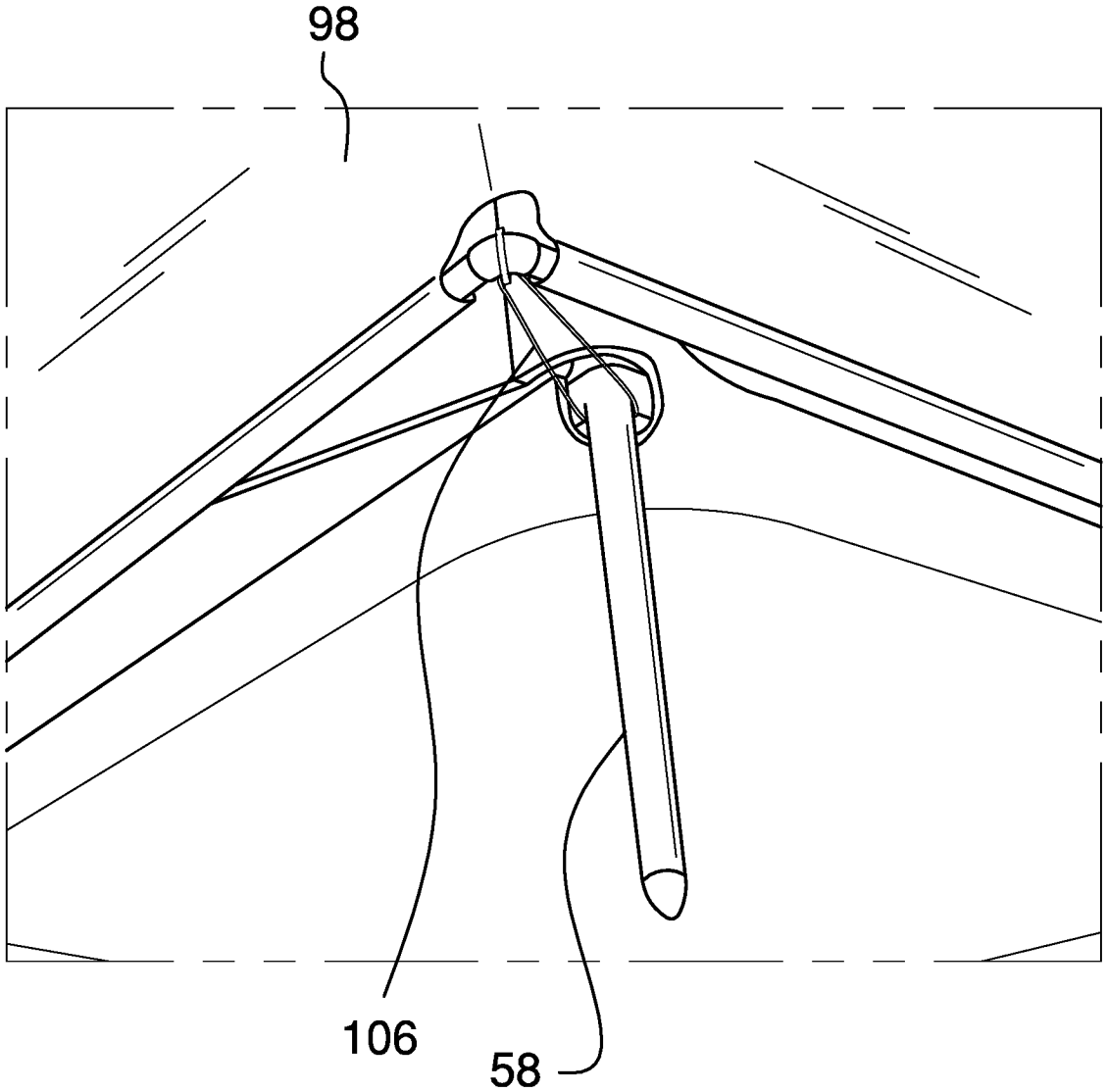
FIG. 8 is a detail view taken from circle 8 of FIG. 5 of an embodiment of the disclosure.
Figure 9:
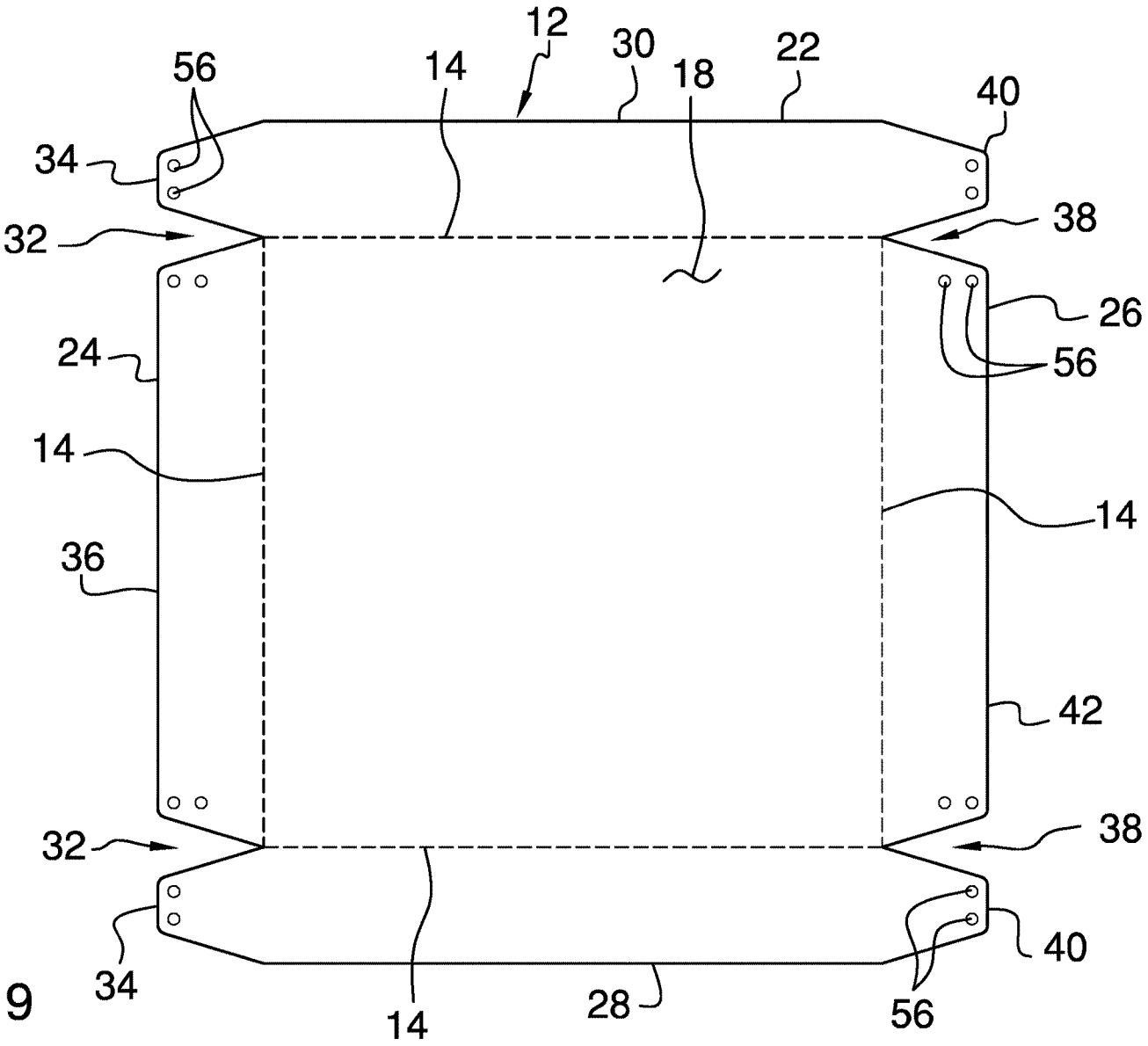
FIG. 9 is a top view of a mat of an embodiment of the disclosure.

With reference now to the drawings, and in particular to FIGS. 1 through 9 thereof, a new canopy device embodying the principles and concepts of an embodiment of the disclosure and generally designated by the reference numeral 10 will be described.

As best illustrated in FIGS. 1 through 9, the portable canopy assembly 10 generally comprises a mat 12 that is foldable along pre-determined fold lines 14 such that the mat 12 forms a box 16. The mat 12 is comprised of a resiliently compressible material for enhancing comfort of a user sitting on the mat 12. The mat 12 has a first surface 18, a second surface 20 and a peripheral edge 22 extending therebetween; the peripheral edge 22 has a first lateral side 24, a second lateral side 26, a front side 28 and a back side 30. The first lateral side 24 has a pair of first cuts 32 each extending toward the second lateral side 26. Each of the first cuts 32 is spaced from a respective front 28 and back 30 sides to define a pair of first flaps 34 between each of the first cuts 32 and the respective front 28 and back 30 sides. Additionally, the first cuts 32 define a second flap 36 extending between each of the first cuts 32.

The second lateral side 26 has a pair of second cuts 38 each extending toward the first lateral side 24. Each of the second cuts 38 is spaced from a respective front 28 and back 30 sides to define a pair of third flaps 40 extending between each of the second cuts 38 and the respective front 28 and back 30 sides. Additionally, the second cuts 38 define a fourth flap 42 extending between each of the second cuts 38. Each of the pre-determined fold lines 14 extends along and is spaced inwardly from a respective one of the first lateral 24, second lateral 26, front 28 and back 30 sides of the peripheral edge 22 of the mat 12.

Each of the second 36 and fourth 42 flaps is folded upwardly to define a respective first 44 and second 46 lateral wall of the box 16. Additionally, the mat 12 is folded upwardly along each of the fold lines 14 that are spaced from the front 28 and back 30 sides of the peripheral edge 22 of the mat 12 to define a respective front 48 and back 50 wall of the box 16. Each of the first flaps 34 releasably engages the second flap 36 for defining the box 16 and each of the third flaps 40 releasably engages the fourth flap 42 for defining the box 16. The first surface 18 of the mat 12 may have a plurality of depressions 52 that intersect each other for defining a plurality of sections 54 of the mat 12. Moreover, the mat 12 can be folded onto itself along the fold lines 14 and along each of the depressions 52 for reducing the size of the mat 12 for storage or transportation.

A plurality of fasteners 56, such as snaps or other type of releasable fastener, is provided. Each of the fasteners 56 is coupled to a respective one of the first 34, second 36, third 40 and fourth 42 flaps. The fasteners 56 on each of the first flaps 34 are aligned with and releasably engage respective fasteners 56 on the second flap 36 when the box 16 is defined. Moreover, the fasteners 56 on each of the third flaps 40 are aligned with and releasably engage respective fasteners 56 on the fourth flap 42 when the box 16 is defined.

A plurality of stakes 58 is included and each of the stakes 58 is extendable through the mat 12 at predetermined locations when the mat 12 is folded to define the box 16. Thus, each of the stakes 58 penetrates a support surface 60, such as ground or the like, for inhibiting the box 16 from sliding on the support surface 60. Each of the stakes 58 has a first end 62 and a second end 64, and the first end 62 of each of the stakes 58 tapers to a point. Moreover, each of the stakes 58 has a pair of fingers 66 each extending laterally away from the stakes 58. The fingers 66 on a respective one of the stakes 58 are aligned with the second end 64 of the respective stake 58. Additionally, the fingers 66 on the respective stake 58 are oriented at a right angle with respect to each other on the respective stake 58. Each of the stakes 58 is extendable through a respective one of the first 32 and second 38 cuts when the mat 12 is folded into the box 16. The fingers 66 on each of the stakes 58 rest on the first surface 18 of the mat 12 when the stakes 58 are extended through the respective first 32 and second 38 cuts. In this way the box 16 is inhibited from being lifted or otherwise displaced on the support surface 60.

A frame 68 is provided and the frame 68 is positionable between a collapsed position and a deployed position. The frame 68 defines a half shell when the frame 68 is positioned in the deployed position. Additionally, the frame 68 is positionable around the box 16 when the mat 12 is folded to define the box 16. The frame 68 comprises a pair of pivots 70, and each of the pivots 70 may have a plurality of portions 72, such as disks or the like, that are each pivotally coupled together.

The frame 68 includes a first section 74 that comprises a central member 76 extending between a pair of outward members 78. Each of the outward members 78 has a distal end 80 with respect to the central member 76, and the distal end 80 of each of the outward members 78 is coupled to a respective portion 72 of a respective one of the pivots 70. The frame 68 includes a second section 82 of the frame 68 comprising a central member 84 extending between a pair of outward members 86. Each of the outward members 86 of the second section 82 has a distal end 88 with respect to the central member 84 of the second section 82. Additionally, the distal end 88 of each of the outward members 86 of the second section 82 is coupled to a respective portion 72 of a respective one of the pivots 70.

The frame 68 includes a third section 90 of the frame 68 comprising a central member 92 extending between a pair of outward members 94. Each of the outward members 94 of the third section 90 has a distal end 96 with respect to the central member 92 of the third section 90. The distal end 96 of each of the outward members 94 of the third section 90 is coupled to a respective portion 72 of a respective one of the pivots 70. The central member 84 of the second section 82 is positioned between and is spaced from the central member 76,92 of each of the first 74 and third 90 sections when the frame 68 is positioned in the deployed position. Conversely, the central member 76,84,92 of the first 74, second 82 and third 90 sections rest on each other when the frame 68 is positioned in the folded position.

A canopy 98 is coupled to the frame 68 such that the canopy 98 extends partially over the box 16 when the frame 68 is positioned in the deployed position. The canopy 98 is comprised of an opaque material such that the canopy 98 shades the box 16 when the frame 68 is positioned in the deployed position. The canopy 98 has a front edge 100 and a back edge 102. The front edge 100 is attached to the central member 92 and each of the outward members 94 of the third section 90. Additionally, the back edge 102 is attached to the central member 76 and each of the outward members 78 of the first section 74. The canopy 98 is stretched over the second section 82 when the frame 68 is positioned in the deployed position. The canopy 98 may have a plurality of cutouts 104 that are each aligned with strategic locations with respect to the frame 68 for accessing the strategic locations through the canopy 98.

A plurality of cords 106 is provided and each of the cords 106 is coupled to an intersection between the central member 76 and a respective one of the outward members 78 of the first section 74 of the frame 68. Each of the cords 106 may be comprised of a resiliently stretchable material. Additionally, each of the cords 106 has a respective one of the stakes 58 extended therethrough when the frame 68 is positioned around the box 16 for removably coupling the frame 68 to the box 16.

In use, the mat 12 is laid on the support surface 60 during an outdoor event or the like, and the mat 12 is folded in the previously disclosed manner to form the box 16. The frame 68 is positioned in the deployed position and the frame 68 is positioned around the box 16. In this way the canopy 98 extends over a substantial portion of the box 16 for shade. Each of the stakes 58 is extended through the respective first 32 and second 38 cuts for inhibiting the box 16 from moving on the support surface 60. Additionally, respective ones of the stakes 58 are extended through a respective one of the cords 106 on the frame 68 when the stakes 58 are extended into the ground. In this way both the box 16 and the frame 68 are inhibited from moving on the support surface 60. The frame 68 is positioned in the collapsed position and the mat 12 is folded onto itself for transporting, and subsequently storing, the frame 68 and the mat 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A portable canopy assembly having a box portion being partially covered by a canopy, said assembly comprising:

a mat being foldable along pre-determined fold lines such that said mat forms a box, said mat being comprised of a resiliently compressible material for enhancing comfort of a user sitting on said mat;

a plurality of stakes, each of said stakes being extendable through said mat at predetermined locations when said mat is folded to define said box wherein each of said stakes is configured to penetrate a support surface for inhibiting said box from sliding on the support surface;

a frame being positionable between a collapsed position and a deployed position, said frame defining a half shell when said frame is positioned in said deployed position, said frame being positionable around said box when said mat is folded to define said box; and a canopy being coupled to said frame such that said canopy extends partially over said box when said frame is positioned in said deployed position wherein said canopy is configured to shade said box.

2. The assembly according to claim 1, wherein:

said mat has a first surface, a second surface and a peripheral edge extending therebetween, said peripheral edge having a first lateral side, a second lateral side, a front side and a back side;

said first lateral side has a pair of first cuts each extending toward said second lateral side, each of said first cuts being spaced from a respective front and back side to define a pair of first flaps between each of said first cuts and said respective front and back side, said first cuts defining a second flap extending between each of said first cuts;

said second lateral side has a pair of second cuts each extending toward said first lateral side, each of said second cuts being spaced from a respective front and back side to define a pair of third flaps extending between each of said second cuts and said respective front and back side, said second cuts defining a fourth flap extending between each of said second cuts; and each of said pre-determined fold lines extends along and being spaced inwardly from a respective one of said first lateral, second lateral, front and back sides of said peripheral edge of said panel.

3. The assembly according to claim 2, wherein each of said second and fourth flaps is folded upwardly to define a respective first and second lateral wall of said box.

4. The assembly according to claim 3, wherein said mat is folded upwardly along each of said fold lines that are spaced from said front and back sides of said peripheral edge of said mat to define a respective front and back wall of said box.

5. The assembly according to claim 3, wherein:

each of said first flaps releasably engages said second flap for defining said box; and each of said third flaps releasably engages said fourth flap for defining said box.

6. The assembly according to claim 2, wherein each of said stakes has a first end and a second end, said first end of each of said stakes tapering to a point, each of said stakes having a pair of fingers each extending laterally away from said stakes, said fingers on a respective one of said stakes being aligned with said second end of said respective stake, said fingers on said respective stake being oriented at a right angle with respect to each other on said respective stake.

7. The assembly according to claim 6, wherein each of said stakes is extendable through a respective one of said first and second cuts when said mat is folded into said box having said fingers on each of said stakes resting on said first surface of said mat when said stakes are extended through said respective first and second cuts thereby inhibiting said box from being lifted.

8. The assembly according to claim 2, wherein said frame comprises:

a pair of pivots;

a first section of said frame comprising a central member extending between a pair of outward members, each of said outward members having a distal end with respect to said central member, said distal end of each of said outward members being coupled to a respective one of said pivots;

a second section of said frame comprising a central member extending between a pair of outward members, each of said outward members of said second section having a distal end with respect to said central member of said second section, said distal end of each of said outward members of said second section being coupled to a respective one of said pivots;

a third section of said frame comprising a central member extending between a pair of outward members, each of said outward members of said third section having a distal end with respect to said central member of said third section, said distal end of each of said outward members of said third section being coupled to a respective one of said pivots; and said central member of said second section being positioned between and being spaced from said central member of each of said first and third sections when said frame is positioned in said deployed position, said central member of said first, second and third sections resting on each other when said frame is positioned in said folded position.

9. The assembly according to claim 8, wherein said canopy has a front edge and a back edge, said front edge being attached to said central member and each of said outward members of said third section, said back edge being attached to said central member and each of said outward members of said first section, said canopy being stretched over said second section when said frame is positioned in said deployed position.

10. The assembly according to claim 9, further comprising a plurality of cords, each of said cords being coupled to an intersection between said central member and a respective one of said outward members of said first section of said frame, each of said cords having a respective one of said stakes being extended therethrough when said frame is positioned around said box for removably coupling said frame to said box.

11. A portable canopy assembly having a box portion being partially covered by a canopy, said assembly comprising:

a mat being foldable along pre-determined fold lines such that said mat forms a box, said mat being comprised of a resiliently compressible material for enhancing comfort of a user sitting on said mat, said mat having a first surface, a second surface and a peripheral edge extending therebetween, said peripheral edge having a first lateral side, a second lateral side, a front side and a back side, said first lateral side having a pair of first cuts each extending toward said second lateral side, each of said first cuts being spaced from a respective front and back side to define a pair of first flaps between each of said first cuts and said respective front and back side, said first cuts defining a second flap extending between each of said first cuts, said second lateral side having a pair of second cuts each extending toward said first lateral side, each of said second cuts being spaced from a respective front and back side to define a pair of third flaps extending between each of said second cuts and said respective front and back side, said second cuts defining a fourth flap extending between each of said second cuts, each of said pre-determined fold lines extending along and being spaced inwardly from a respective one of said first lateral, second lateral, front and back sides of said peripheral edge of said panel, each of said second and fourth flaps being folded upwardly to define a respective first and second lateral wall of said box, said mat being folded upwardly along each of said fold lines that are spaced from said front and back sides of said peripheral edge of said mat to define a respective front and back wall of said box, each of said first flaps releasably engaging said second flap for defining said box, each of said third flaps releasably engaging said fourth flap for defining said box;

a plurality of stakes, each of said stakes being extendable through said mat at predetermined locations when said mat is folded to define said box wherein each of said stakes is configured to penetrate a support surface for inhibiting said box from sliding on the support surface, each of said stakes having a first end and a second end, said first end of each of said stakes tapering to a point, each of said stakes having a pair of fingers each extending laterally away from said stakes, said fingers on a respective one of said stakes being aligned with said second end of said respective stake, said fingers on said respective stake being oriented at a right angle with respect to each other on said respective stake, each of said stakes being extendable through a respective one of said first and second cuts when said mat is folded into said box having said fingers on each of said stakes resting on said first surface of said mat when said stakes are extended through said respective first and second cuts thereby inhibiting said box from being lifted;

a frame being positionable between a collapsed position and a deployed position, said frame defining a half shell when said frame is positioned in said deployed position, said frame being positionable around said box when said mat is folded to define said box, said frame comprising:

a pair of pivots;

a first section of said frame comprising a central member extending between a pair of outward members, each of said outward members having a distal end with respect to said central member, said distal end of each of said outward members being coupled to a respective one of said pivots;

a second section of said frame comprising a central member extending between a pair of outward members, each of said outward members of said second section having a distal end with respect to said central member of said second section, said distal end of each of said outward members of said second section being coupled to a respective one of said pivots; and a third section of said frame comprising a central member extending between a pair of outward members, each of said outward members of said third section having a distal end with respect to said central member of said third section, said distal end of each of said outward members of said third section being coupled to a respective one of said pivots, said central member of said second section being positioned between and being spaced from said central member of each of said first and third sections when said frame is positioned in said deployed position, said central member of said first, second and third sections resting on each other when said frame is positioned in said folded position;

a canopy being coupled to said frame such that said canopy extends partially over said box when said frame is positioned in said deployed position wherein said canopy is configured to shade said box, said canopy having a front edge and a back edge, said front edge being attached to said central member and each of said outward members of said third section, said back edge being attached to said central member and each of said outward members of said first section, said canopy being stretched over said second section when said frame is positioned in said deployed position; and a plurality of cords, each of said cords being coupled to an intersection between said central member and a respective one of said outward members of said first section of said frame, each of said cords having a respective one of said stakes being extended therethrough when said frame is positioned around said box for removably coupling said frame to said box.

* * * * *